US009756433B2

(12) United States Patent
Bern et al.

(10) Patent No.: US 9,756,433 B2
(45) Date of Patent: Sep. 5, 2017

(54) MEASUREMENT APPARATUS FOR TESTING AND CALIBRATING BONE-CONDUCTION VIBRATORS

(71) Applicant: OTICON MEDICAL A/S, Smørum (DK)

(72) Inventors: Bengt Bern, Mölndal (SE); Jens Balslev, Smørum (DK)

(73) Assignee: OTICON MEDICAL A/S, Smorum (DK)

( * ) Notice: Subject to any disclaimer, the term of this patent is extended or adjusted under 35 U.S.C. 154(b) by 23 days.

(21) Appl. No.: 14/225,648

(22) Filed: Mar. 26, 2014

(65) Prior Publication Data

US 2014/0294186 A1 Oct. 2, 2014

(30) Foreign Application Priority Data

Mar. 27, 2013 (EP) ..... 13161239

(51) Int. Cl.
*H04R 25/00* (2006.01)
*H04R 29/00* (2006.01)

(52) U.S. Cl.
CPC ..... *H04R 25/30* (2013.01); *H04R 29/001* (2013.01); *H04R 2460/13* (2013.01)

(58) Field of Classification Search
None
See application file for complete search history.

(56) References Cited

U.S. PATENT DOCUMENTS 5,771,298 A 6/1998 Davis et al.
8,798,292 B2 * 8/2014 Kubba ..... G02B 27/017 181/135
2009/0192345 A1 * 7/2009 Westerkull ..... H04R 25/606 600/25

(Continued)

OTHER PUBLICATIONS

Lopez-Higuera, J.M., Morante, M.A., and Cobo, A,, "Simple low-frequency optical fiber accelerometer with large rotating machine monitoring applications," Journal of Lightwave Technology, vol. 15, pp. 1120-1130, 1997.*

(Continued)

*Primary Examiner* — Kenny Truong
(74) *Attorney, Agent, or Firm* — Birch, Stewart, Kolasch & Birch, LLP

(57) ABSTRACT

A skull simulator tests and calibrates bone-conduction vibrators under realistic operating conditions. In known skull simulators, the front wall of the casing—and/or exposed parts of the suspension—have one or more planar surfaces on the front, and these planar surfaces are thus oriented towards the bone-conduction vibrator when it is mounted on the skull simulator. Such planar surfaces may reflect air-borne sound from the vibrator housing or may emit sounds themselves when vibrating, and the reflected or emitted sound contributes to resonances are not present when the bone-conduction vibrator is mounted on a human head. In the current design all exposed parts on the front located outside a coupling surface for connecting the bone-conduction vibrator do not have planar surfaces perpendicular to the main oscillation axis or that otherwise, such planar surfaces comprising an acoustic foam having an acoustic dampening effect on sound waves impinging thereon.

24 Claims, 3 Drawing Sheets

(56) References Cited

U.S. PATENT DOCUMENTS

| | | | | |
|---|---|---|---|---|
| 2009/0259090 | A1* | 10/2009 | Parker | A61N 1/36032 600/25 |
| 2010/0041940 | A1* | 2/2010 | Hillbratt | H04R 25/70 600/25 |
| 2012/0286765 | A1* | 11/2012 | Heuvel | H04R 25/606 324/76.49 |
| 2013/0039520 | A1 | 2/2013 | Margolis et al. | |
| 2014/0283614 | A1* | 9/2014 | Inagaki | H04M 1/24 73/649 |

OTHER PUBLICATIONS

European Search Report issued in 13161239.2, dated Jul. 25, 2013.
Hakansson et al. "Skull simulator for direct bone conduction hearing devices," Scandinavian Audiology, Scandinavian University Press, Jan. 1, 1989, vol. 18, No. 2, pp. 91-98.

* cited by examiner

MEASUREMENT APPARATUS FOR TESTING AND CALIBRATING BONE-CONDUCTION VIBRATORS

TECHNICAL FIELD

The present invention relates to a measurement apparatus for testing and calibrating bone-conduction vibrators. More specifically, the present invention relates to a so-called skull simulator or artificial mastoid commonly used in production, testing, calibration and fitting of bone-conduction hearing devices.

BACKGROUND ART

Basically, a skull simulator consists of an inertial mass with a coupling surface and a measurement device or means. The coupling surface serves as a receptacle on which a vibration element of a bone-conduction hearing device or a bone-conduction vibrator being part of such a bone-conduction hearing device may be mounted for testing, and the measurement device or means serves to determine the vibration force applied by the bone-conduction vibrator to the inertial mass. The inertial mass is ideally designed to provide an acoustic impedance towards the bone-conduction vibrator equal to that provided by the skull bone or the head of an average hearing-device user at the position on the skull bone or the head where the bone-conduction vibrator is to be arranged during normal use of the hearing device. The skull simulator may thus be used to measure the output force of bone-conduction vibrators under realistic operating conditions, e.g. for testing or calibration purposes.

In known skull simulators, the inertial mass typically comprises an elastically suspended, rigid body, such as a metal cylinder, with an accelerometer rigidly attached at a rear end. The opposite front end of the rigid body may serve directly as coupling surface, or a suitable fixture with a coupling surface may be rigidly attached thereto. For measuring of transcutaneous bone-conduction vibrators, the coupling surface may be covered by one or more layers of materials, such as rubber, designed to simulate the acoustic impedance of skin and tissue covering the skull bone. Due to the known correlation between the acceleration of a body and the vibration force applied to it, the output of the accelerometer may be used as a measure for the force applied to the inertial mass and thus for the output force of the bone-conduction vibrator.

Some known skull simulators comprise a protective casing shaped substantially as a rectangular cuboid, i.e. with top and bottom walls, two side walls, a front wall and a rear wall. The top, bottom and side walls are typically integral with each other and form a sleeve within which the inertial mass and the elastic suspension is mounted. The front and rear walls are secured to the sleeve with bolts or screws, either directly or indirectly via parts of the suspension. The coupling surface is either accessible through a central through hole in the front wall, or the corresponding portion of the rigid body or the fixture extends through such a through hole such that the coupling surface is external to the casing. In use, the skull simulator is arranged to stand on the bottom wall, preferably acoustically decoupled from the supporting surface by means of elastic and/or damping feet or pads. The coupling surface is arranged such that the bone-conduction vibrator applies its vibration force horizontally, which allows for using relatively simple, vertically oriented planar springs to suspend the inertial mass. In other known skull simulators, the casing is cylindrical and stands on one end of the cylinder, and the coupling surface is arranged such that the bone-conduction vibrator applies its vibration force vertically.

In the prior art skull simulators known to the inventors of the present invention, the front wall of the casing—and/or exposed parts of the suspension—have one or more planar surfaces on the front, and these planar surfaces are thus oriented towards the bone-conduction vibrator when it is mounted on the skull simulator.

The inventors of the present invention have now surprisingly established that this particular feature poses a cause for irregularities in the measurement results. The planar surfaces may reflect airborne sound emitted from the housing of the bone-conduction vibrator or emit sounds themselves when vibrating, and the reflected or emitted sound contributes to the build-up of resonances which are not present when the bone-conduction vibrator is mounted on a human head.

DISCLOSURE OF INVENTION

It is an object of the present invention to provide a measurement apparatus for testing and calibrating bone-conduction vibrators, which apparatus does not suffer from the above problem.

This and other objects of the invention are achieved by the invention defined in the accompanying independent claims and as explained in the following description. Further objects of the invention are achieved by the embodiments defined in the dependent claims and in the detailed description of the invention.

By designing the measurement apparatus such that all exposed parts on the front located outside the coupling surface do not have planar surfaces perpendicular to the main oscillation axis or that otherwise, such planar surfaces consist of an acoustic foam having an acoustic dampening effect on sound waves impinging thereon, it is achieved that reflection or emission of airborne sound by such planar surfaces is reduced or less pronounced, which reduces resonances, and therefore the influence of such resonances on the measurement results is also reduced.

In the present context, a "bone-conduction hearing device" refers to a device, such as e.g. a hearing aid or a listening device, which is adapted to improve and/or augment the hearing capability of a user by receiving acoustic signals from the user's surroundings, generating corresponding audio signals, possibly modifying the audio signals and providing the possibly modified audio signals as audible signals to at least one of the user's ears. Such audible signals may e.g. be provided in the form of acoustic signals transferred as mechanical vibrations to the user's inner ears through the bone structure of the user's head.

A bone-conduction hearing device may be configured to be worn in any suitable way, e.g. as a unit attached to a fixture implanted into the skull bone or as a unit held against the skin of the head by means of a spring or other elastic means. A bone-conduction hearing device may comprise a single unit or several units communicating electronically with each other.

More generally, a bone-conduction hearing device comprises an input transducer for receiving an acoustic signal from a user's surroundings and providing a corresponding input audio signal and/or a receiver for electronically receiving an input audio signal, a signal processing circuit for processing the input audio signal and an output means for providing an audible signal to the user in dependence on the processed audio signal. Some hearing devices may comprise multiple input transducers, e.g. for providing direction-dependent audio signal processing. In some hearing devices, the receiver may be a wireless receiver. In some hearing devices, the receiver may be e.g. an input amplifier for receiving a wired signal. In some hearing devices, an amplifier may constitute the signal processing circuit. In some hearing devices, the output means may comprise an output transducer, such as e.g. a vibrator for providing a structure-borne acoustic signal. In some hearing devices, the vibrator may be adapted to provide a structure-borne acoustic signal transcutaneously or percutaneously to the skull bone.

As used herein, the singular forms "a", "an", and "the" are intended to include the plural forms as well (i.e. to have the meaning "at least one"), unless expressly stated otherwise. It will be further understood that the terms "has", "includes", "comprises", "having", "including" and/or "comprising", when used in this specification, specify the presence of stated features, integers, steps, operations, elements and/or components, but do not preclude the presence or addition of one or more other features, integers, steps, operations, elements, components and/or groups thereof. It will be understood that when an element is referred to as being "connected" or "coupled" to another element, it can be directly connected or coupled to the other element, or intervening elements may be present, unless expressly stated otherwise. As used herein, the term "and/or" includes any and all combinations of one or more of the associated listed items.

BRIEF DESCRIPTION OF THE DRAWINGS

The invention will be explained in more detail below in connection with preferred embodiments and with reference to the drawings in which.

The figures are schematic and simplified for clarity, and they just show details, which are essential to the understanding of the invention, while other details are left out. Throughout, like reference numerals and/or names are used for identical or corresponding parts.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from this detailed description.

MODE(S) FOR CARRYING OUT THE INVENTION

Figure 1:
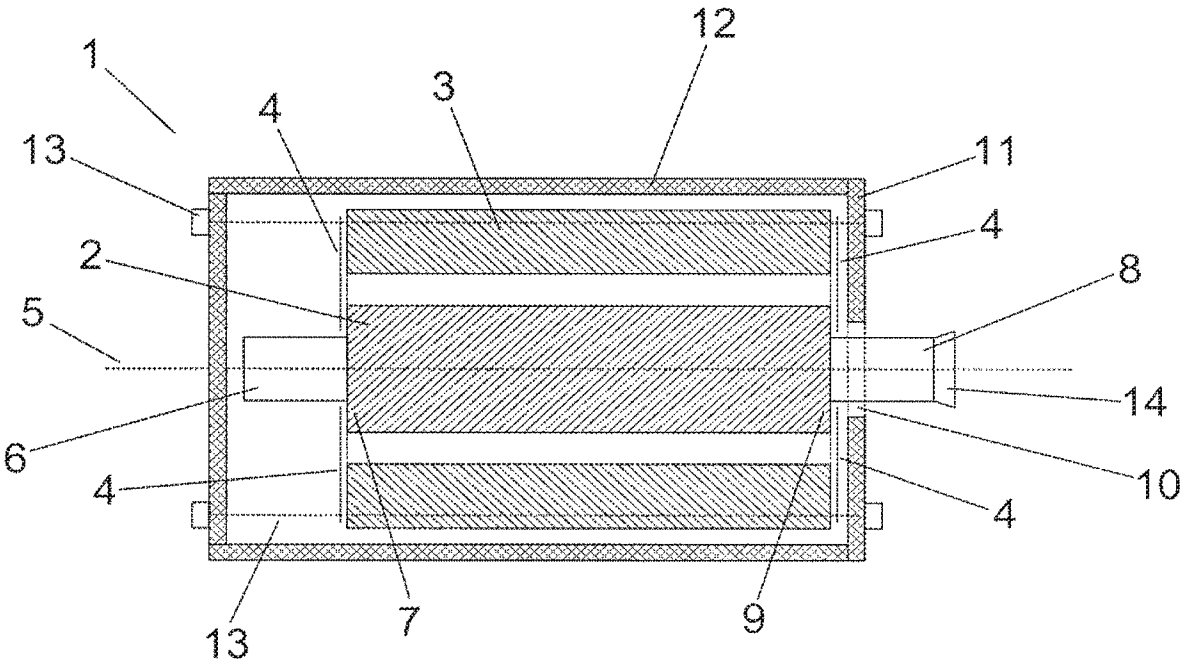
FIG. 1 PRIOR ART
FIG. 1 shows an embodiment of a prior art skull simulator.

The prior art skull simulator 1 shown in FIG. 1 comprises a rigid body 2 elastically suspended in a rigid bracket 3 by means of planar springs 4. The planar springs 4 allow the rigid body 2 to oscillate along a main oscillation axis 5. An accelerometer 6 is rigidly attached to the rear end 7 of the rigid body 2 and a fixture 8 is rigidly attached to the front end 9 of the rigid body 2. The fixture 8 extends through a through hole 10 in a substantially planar front wall 11 of the skull simulator casing 12. The rigid bracket 3 is fastened to the casing 12 by means of several bolts 13. The fixture 8 has a coupling surface 14 providing a mechanical interface for connecting a vibration element of a bone-conduction vibrator (not shown).

Figure 2:
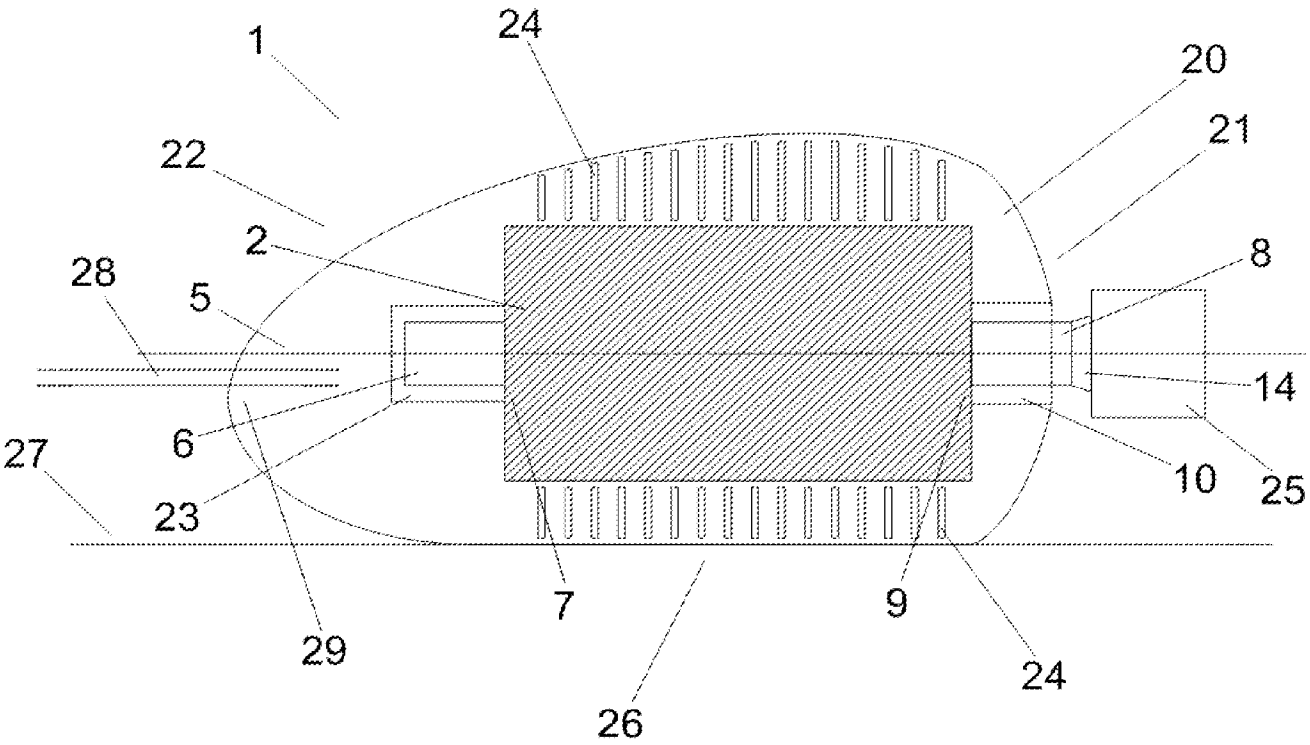
FIG. 2 shows a first embodiment of a measurement apparatus according to the invention.

A first embodiment of a measurement apparatus 1 according to the invention is shown in FIG. 2 and comprises a rigid body 2 embedded and thus elastically suspended in a suspension body 20 consisting substantially of acoustic foam having an acoustic dampening effect on sound waves impinging on it—at least for sound frequencies within an upper portion of the audible frequency range, e.g. between 1 kHz and 20 kHz or between 3 kHz and 10 kHz. The acoustic foam may be e.g. a polyurethane foam, and many suitable acoustic foam materials are known in the art. The measurement apparatus 1 has a front 21 and a rear 22, and the suspension body 20 allows the rigid body 2 to oscillate along a main oscillation axis 5 oriented in the front-rear direction of the measurement apparatus 1. The rigid body 2 is preferably shaped like a rotation-symmetric cylinder, and the cylinder axis is preferably aligned with the main oscillation axis 5. An accelerometer 6 is rigidly attached to the rear end 7 of the rigid body 2 and a fixture 8 is rigidly attached to the front end 9 of the rigid body 2. The accelerometer 6 is arranged in a cavity 23 in the suspension body 20 such that it does not touch the acoustic foam. The fixture 8 extends through a through hole 10 in the front of the suspension body 20, which allows attachment of a vibration element of a bone-conduction vibrator 25 to a coupling surface 14 on the exposed front end of the fixture 8.

The coupling surface 14 provides a mechanical interface identical to the one provided by skull implants for bone-conduction hearing devices. Such skull implants typically comprise a titanium screw which is osseointegrated into the skull bone of the hearing-device user. A so-called abutment is attached to the implant, typically by means of a further screw, and the abutment provides the actual mechanical interface to the bone-conduction vibrator 25. The coupling surface 14 may thus e.g. provide an interface identical to the one provided by such abutments, or it may e.g. provide an interface identical to that provided by the implant, such that an abutment can be interchangeably attached thereto. In use, the vibration element of the bone-conduction vibrator 25 is attached to the coupling surface 14 by coupling device or means already known in the art (not shown), and the vibration force from the bone-conduction vibrator 25 causes the rigid body 2, the fixture 8 and the accelerometer 6 to vibrate essentially as a single rigid inertial mass. The electric output signal of the accelerometer 6 indicates the acceleration of this inertial mass 2, 8, 6 and thus also allows the computation of the vibration force applied thereto by the bone-conduction vibrator 25.

The suspension body 20 must be soft or resilient enough to allow the rigid body 2 to move substantially unhindered when driven by the vibrator 25 and at the same time strong enough to carry the weight of the rigid body 2, the fixture 8 and the accelerometer 6. This is preferably achieved by arranging the rigid body 2 and the fixture 8 such that the rigid body 2 oscillates horizontally during measuring, and by providing a suspension that predominantly applies vertically oriented forces to the rigid body 2. The suspension body 20 may thus comprise strings or rods 24 of a material that is harder than the acoustic foam and are vertically oriented. Further such strings or rods 24 may present and be oriented in several other directions perpendicular to the main oscillation axis 5 in order to prevent or reduce oscillations of the rigid body 2 in other directions than the along the main oscillation axis 5.

Due to the acoustic foam constituting the suspension body 20, hard planar surfaces perpendicular to the main oscillation axis 5, such as e.g. the front end of the rigid body 2, are not exposed to acoustic waves impinging on the measurement apparatus 1. These surfaces do thus not contribute to the build-up of resonances. The features of the coupling surface itself 14 are of less or no concern, since the coupling surface 14 will be covered by or abutting the vibration element 25 during measurements. Forward-oriented portions of the suspension body 20 can be planar and/or perpendicular to the main oscillation axis 5 without causing resonances, because the acoustic dampening effect of the acoustic foam also reduces such resonances. However, it is preferred that the front 21 has a shape similar to the blunt end of an egg or a half sphere.

In use, the measurement apparatus 1 is normally placed with the bottom 26 on a supporting surface 27 in a soundproof measurement chamber (not shown), preferably provided as an anechoic chamber. In order to avoid that the measurement apparatus 1 itself contributes to acoustic reflections or emissions within the anechoic chamber, the acoustic foam of the suspension body 20 preferably covers the entire measurement apparatus 1, except for the coupling surface 14 and/or a cable 28 for connecting the measurement apparatus 1 to e.g. a power supply, a measurement electronics and/or a computer (not shown). The bottom 26 of the measurement apparatus 1 may be left free from acoustic foam, since the supporting surface 27 in the chamber is typically itself covered by acoustic foam or other acoustic dampening device or means. Preferably, the measurement apparatus 1 is substantially egg- or tear-shaped, and the cable 28 extends from the acute end 29 of the egg- or tear-shape. However, the bottom 26 of the measurement apparatus 1 is preferably not convex, but rather planar to allow stable placement on a flat supporting surface 27. Instead of a cable 28, the measurement apparatus 1 may comprise a battery (not shown), preferably rechargeable, to power the accelerometer 6, an analog-to-digital converter and a wireless transmitter or transceiver (not shown) to convert and transmit measurement data from the accelerometer 6 to the measurement electronics and/or computer. Any electronics required to e.g. amplify, convert and/or transmit the output of the accelerometer 6, and/or a battery or a power converter for supplying power to the electronics, are preferably mounted on a printed circuit board (not shown) embedded in the suspension body 20 away from the rigid body 2 and close to the bottom 26.

For bone-conduction vibrators 25 of the transcutaneous type, the bone-conduction vibrator 25 is typically held in place by a spring or other elastic means (not shown) pressing the vibration element of the vibrator 25 towards the coupling surface 14. In this case, the coupling surface 14 is preferably a planar surface without further features.

The shown arrangement of the accelerometer 6 at the rear end 7 of the rigid body 2 provides more room at the front end 9 for acoustic foam and/or other resonance dampening device or means. Furthermore, since the vibration force acting on the accelerometer 6 serves to accelerate only the accelerometer itself 6, the influence of resonances in the accelerometer 6 on the measurement results is reduced. The accelerometer 6 may, however, alternatively be arranged at the front end 9 or at other positions of the rigid body 2.

The inertial mass, i.e. the mass of the combined mass of the rigid body 2, the fixture 8 and the accelerometer 6, is typically chosen to be between 50 and 70 g, or preferably about 58 g such that skull simulator mimics the acoustic impedance of the average human skull bone at the most important hearing frequencies. The rigid body 2 and the fixture 8 are preferably made of a copper-zinc-lead alloy, such as CuZn39Pb3.

In the case that the bottom 26 of the measurement apparatus 1 is left free from acoustic foam, the measurement apparatus 1 may preferably be provided with resilient, elastic and/or damping legs, feet or pads (not shown) for supporting the apparatus 1 when measuring in order to prevent that vibrations in the environment reach the rigid body 2.

Figure 3:
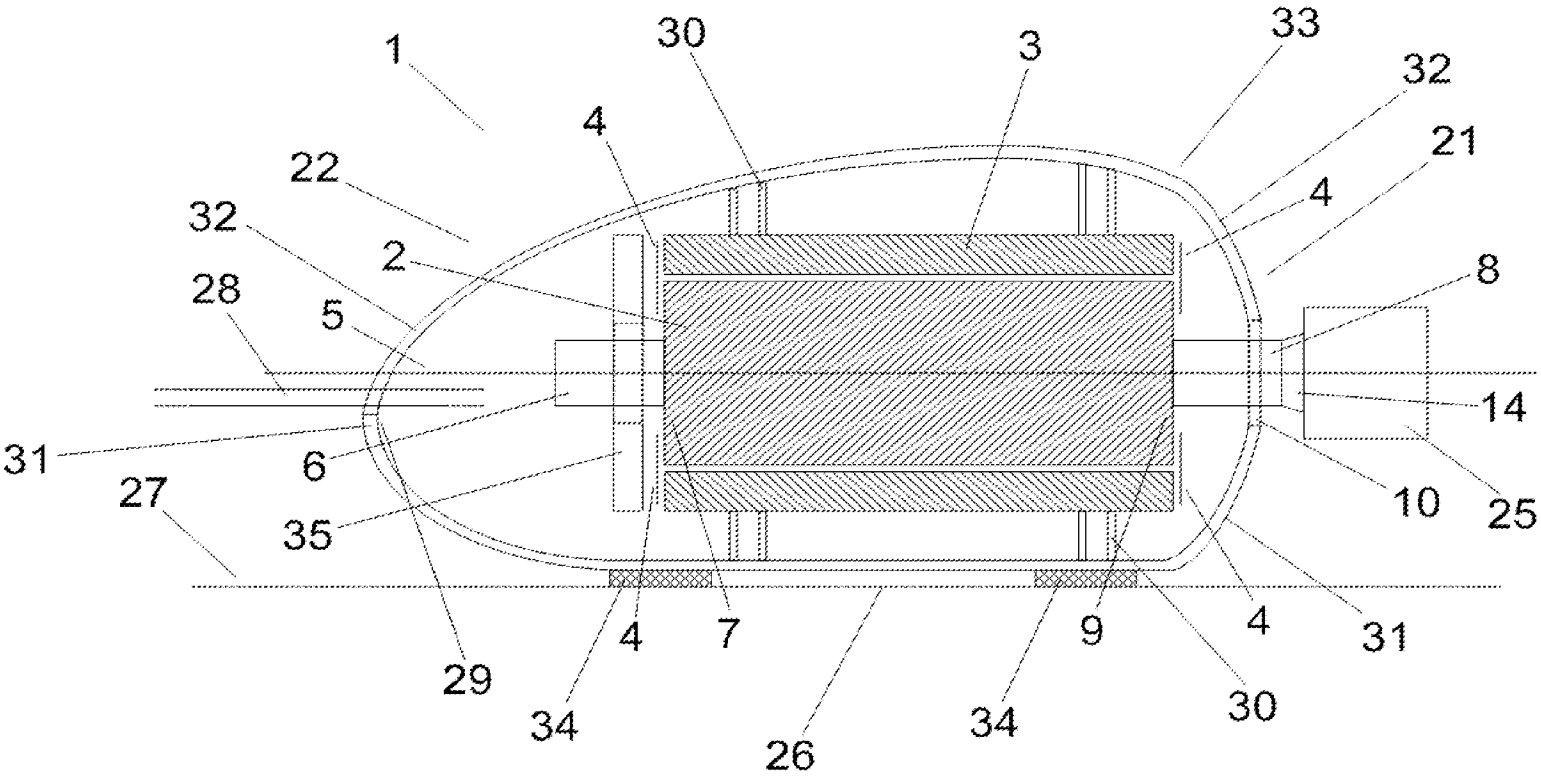
FIG. 3 shows a second embodiment of a measurement apparatus according to the invention.

A second embodiment of a measurement apparatus 1 according to the invention is shown in FIG. 3. The second embodiment comprises substantially the same features as the first embodiment shown in FIG. 2, except for the suspension body 20 of acoustic foam. Instead, the rigid body 2 is suspended in a rigid bracket 3 by means of two or more planar springs 4 arranged at the ends 7, 9 of the rigid body 2 in planes perpendicular to the main oscillation axis 5. The planar springs 4 are preferably secured to the rigid body 2 and to the rigid bracket 3 by means of screws (not shown). The planar springs 4 are designed such that they allow the rigid body 2 to oscillate with respect to the rigid bracket 3 along the main oscillation axis 5 and only to a smaller extent in other directions. The rigid body 2 is preferably shaped like a rotation-symmetric cylinder, and the cylinder axis is preferably aligned with the main oscillation axis 5. The rigid bracket 3 is preferably also shaped like a rotation-symmetric cylinder with a concentric bore for the rigid body 2. The bottom part of the rigid bracket 3 may preferably be planar to allow a low overall height of the measurement apparatus 1. The rigid bracket 3 is preferably made of the same material as the rigid body 2 and preferably has a mass similar to or greater than the mass of the rigid body 2. The rigid bracket 3 is held in place by form-fitting protrusions 30 on the inside of a lower shell 31 and an upper shell 32 together constituting a protective housing 33. The shells 31, 32 are preferably made of a resin, such as an injection-mouldable blend of polycarbonate and ABS plastic, and are secured to each other by means of a screw (not shown). The fixture 8 extends through a through hole 10 in the front of the housing 33, thus allowing attachment of a vibration element of a bone-conduction vibrator 25 to the coupling surface 14.

The front of the housing 33 has a convex shape similar to the blunt end of an egg or a half sphere and is thus less likely to cause resonances with airborne acoustic signals emitted from the bone-conduction vibrator 25 or from itself. The housing 33 is substantially egg- or tear-shaped, and if present, the cable 28 may exit the housing 33 through a through hole at the acute end 29 of the egg- or tear-shape. The smooth and non-planar outer surface of the non-bottom portion of the housing 33 helps to reduce acoustic reflections and emissions, and thus resonances, within smaller measurement chambers. The bottom 26 of the measurement apparatus 1 is preferably not convex, but rather planar to allow stable placement on a flat supporting surface 27. The bottom 26 is preferably provided with resilient, elastic and/or damping pads 34 for supporting the apparatus 1 when measuring.

Any electronics required to e.g. amplify, convert and/or transmit the output of the accelerometer 6, and/or a battery or a power converter for supplying power to the electronics, are preferably mounted on a printed circuit board 35 attached to the rigid bracket 3. The printed circuit board 35 may have a circular or horse-shoe-like shape with a central opening to allow the accelerometer 6 to extend beyond the printed circuit board 35 in the rearwards direction.

In variants of the shown embodiments, the rigid body 2 may be suspended in a rigid bracket 3 by means of planar springs 4, and the rigid bracket 3 may in turn be embedded and thus elastically suspended in the suspension body 20.

In some embodiments, the suspension body 20 may be contained in a protective housing 33, such that the housing 33 constitutes the outer surface of the measurement apparatus 1.

In some embodiments, the entire protective housing 33 or portions thereof may be covered by a layer of acoustic foam having an acoustic dampening effect on sound waves impinging on it.

In some embodiments, the accelerometer 6 may be rigidly attached to the rigid body 2 and measure the acceleration of the rigid body 2 by determining its own absolute acceleration.

In some embodiments, the accelerometer 6 may be rigidly attached to a first element, such as the rigid body 2, or to a second element, such as the bracket 3 or the housing 33, and may measure the acceleration of the rigid body 2 by determining properties of optical signals reflected from the respective other element 2, 3, 33.

Further modifications obvious to the skilled person may be made to the disclosed apparatus without deviating from the scope of the invention. Within this description, any such modifications are mentioned in a non-limiting way.

Some preferred embodiments have been described in the foregoing, but it should be stressed that the invention is not limited to these, but may be embodied in other ways within the subject-matter defined in the following claims. For example, the features of the described embodiments may be combined arbitrarily, e.g. in order to adapt the apparatus according to the invention to specific requirements.

Any reference numerals and names in the claims are intended to be non-limiting for their scope.

The following items may highlight aspects of the present disclosure:

1. Measurement apparatus (1) for testing and calibrating bone-conduction vibrators (25), the apparatus (1) having a front (21) and a rear (22) and comprising: a rigid body (2) elastically suspended such that it may be caused to oscillate along a front-rear-aligned main oscillation axis (5); a coupling surface (14) provided at a front end (9) of the rigid body (2) and adapted to abut a vibration element of a bone-conduction vibrator (25) and to receive a vibration force from the vibration element; and a measurement means (6) arranged and adapted to provide an output signal indicative of an acceleration of the rigid body (2) along the main oscillation axis (5), characterised in that all exposed parts on the front (21) located outside the coupling surface (14) do not have planar surfaces perpendicular to the main oscillation axis (5) or that otherwise, such planar surfaces consist of an acoustic foam having an acoustic dampening effect on sound waves impinging thereon.

2. Measurement apparatus according to item 1, wherein the front (21) has a shape similar to the blunt end of an egg or a half sphere.

3. Measurement apparatus according to item 2, wherein the measurement apparatus (1) is substantially egg- or tear-shaped.

4. Measurement apparatus according to any preceding item, wherein the rigid body (2) is suspended in a rigid bracket (3) by means of one or more planar springs (4).

5. Measurement apparatus according to any preceding item, wherein the rigid body (2) and/or the rigid bracket (3) is suspended by a suspension body (20) of acoustic foam.

6. Measurement apparatus according to item 5, wherein the suspension body (20) of acoustic foam constitutes the outer surface of the measurement apparatus (1).

7. Measurement apparatus according to any of items 1-5, wherein the rigid body (2) is suspended within a protective housing (33) constituting the outer surface of the measurement apparatus (1).

8. Measurement apparatus according to any preceding item, wherein the measurement means (6) is an accelerometer arranged at the rear end (7) of the rigid body (2).

9. Measurement apparatus according to any preceding item, wherein the accelerometer (6) is rigidly attached to the rigid body (2).

10. Measurement apparatus according to any preceding item, wherein the accelerometer (6) is adapted to determine the acceleration of the rigid body (2) by optical means.

11. Measurement apparatus according to any preceding item, further comprising a coupling means for maintaining the bone-conduction vibrator (25) in a position wherein the vibration element abuts the coupling surface (14).

The invention claimed is:

1. Measurement apparatus for testing and calibrating bone-conduction vibrators, the apparatus comprising:

a suspension body including a front and a rear, said suspension body being formed of acoustic foam;

a rigid body elastically suspended within the suspension body and configured to oscillate along a front-rear-aligned main oscillation axis, the rigid body including a front end aligned with the front of the suspension body;

a coupling surface provided at the front end of the rigid body and adapted to abut a vibration element of a bone-conduction vibrator and to receive a vibration force from the vibration element, wherein the vibration element is configured to be positioned outside of and on the front side of the suspension body, such that the vibration force from the vibration element is conveyed via the coupling surface from outside the suspension body toward the rigid body; and a measurement device arranged and adapted to provide an output signal indicative of an acceleration of the rigid body, caused by the vibration force, along the main oscillation axis, wherein an outer surface of the front of the suspension body located outside the coupling surface includes a front wall having a non-planar portion, such that all exposed portions of the front wall at the front of the suspension body and oriented towards the vibration element are non-planar.

2. Measurement apparatus according to claim 1, wherein the front of the suspension body has a shape or geometry substantially of a partial spheroid.

3. Measurement apparatus according to claim 1, wherein the measurement apparatus is substantially egg- or tear-shaped.

4. Measurement apparatus according to claim 1, wherein the rigid body is suspended in a rigid bracket by one or more planar springs.

5. Measurement apparatus according to claim 4, wherein the rigid bracket is suspended by the suspension body.

6. Measurement apparatus according to claim 5, wherein the suspension body of acoustic foam constitutes the outer surface of the measurement apparatus.

7. Measurement apparatus according to claim 1, wherein the rigid body is suspended by the suspension body.

8. Measurement apparatus according to claim 1, wherein the suspension body is a protective housing constituting the outer surface of the measurement apparatus.

9. Measurement apparatus according to claim 1, wherein the measurement device is an accelerometer arranged at a rear end of the rigid body.

10. Measurement apparatus according to claim 9, wherein the accelerometer is rigidly attached to the rigid body.

11. Measurement apparatus according to claim 9, wherein the accelerometer is adapted to determine the acceleration of the rigid body by determining properties of optical signals reflected from the rigid body, the suspension body, or a bracket suspending the rigid body.

12. Measurement apparatus according to claim 1, further comprising:

a coupling device for maintaining the bone-conduction vibrator in a position wherein the vibration element abuts the coupling surface.

13. Measurement apparatus according to claim 1, wherein said suspension body comprises a mechanism to reduce oscillations of said rigid body in directions other than along the main oscillation axis.

14. Measurement apparatus for testing and calibrating bone-conduction vibrators, the apparatus comprising:

a suspension body including a front and a rear;

a rigid body elastically suspended within the suspension body and configured to oscillate along a front-rear-aligned main oscillation axis;

a coupling surface provided at a front end of the rigid body and adapted to abut a vibration element of a bone-conduction vibrator and to receive a vibration force from the vibration element, wherein the vibration element is configured to be positioned outside of and on the front side of the suspension body, such that the vibration force from the vibration element is conveyed via the coupling surface from outside the suspension body toward the rigid body; and a measurement device arranged and adapted to provide an output signal indicative of an acceleration of the rigid body, caused by the vibration force, along the main oscillation axis, wherein an outer surface of the front of the suspension body is oriented towards the vibration element, is located outside the coupling surface, is substantially perpendicular to the main oscillation axis and includes an acoustic foam having an acoustic dampening effect on sound waves impinging thereon.

15. Measurement apparatus according to claim 14, wherein the front of the suspension body has a shape or geometry substantially of a partial spheroid.

16. Measurement apparatus according to claim 14, wherein the measurement apparatus is substantially egg- or tear-shaped.

17. Measurement apparatus according to claim 14, wherein the rigid body is suspended in a rigid bracket by one or more planar springs.

18. Measurement apparatus according to claim 17, wherein the rigid bracket is suspended by the suspension body, the suspension body being made of acoustic foam.

19. Measurement apparatus according to claim 18, wherein the suspension body of acoustic foam constitutes the outer surface of the measurement apparatus.

20. Measurement apparatus according to claim 14, wherein the rigid body is suspended by the suspension body, the suspension body being made of acoustic foam.

21. Measurement apparatus according to claim 14, wherein the suspension body is a protective housing constituting the outer surface of the measurement apparatus.

22. Measurement apparatus according to claim 13, wherein said mechanism to reduce oscillation includes vertically oriented strings or rods.

23. Measurement apparatus according to claim 14, wherein said suspension body comprises a mechanism to reduce oscillations of said rigid body in directions other than along the main oscillation axis.

24. Measurement apparatus according to claim 23, wherein said mechanism to reduce oscillation includes vertically oriented strings or rods.

* * * * *